US011421667B2

(12) United States Patent
Wade

(10) Patent No.: US 11,421,667 B2
(45) Date of Patent: Aug. 23, 2022

(54) HIGH-VISCOSITY PUMPING SYSTEM

(71) Applicant: J-KEM Scientific, Inc., St. Louis, MO (US)

(72) Inventor: Gabriel Wade, University City, MO (US)

(73) Assignee: J-KEM Scientific, Inc., St. Louis, MO (US)

( * ) Notice: Subject to any disclaimer, the term of this patent is extended or adjusted under 35 U.S.C. 154(b) by 99 days.

(21) Appl. No.: 16/283,048

(22) Filed: Feb. 22, 2019

(65) Prior Publication Data

US 2019/0264669 A1 Aug. 29, 2019

Related U.S. Application Data

(60) Provisional application No. 62/634,567, filed on Feb. 23, 2018.

(51) Int. Cl.

| | |
|---|---|
| ***F04B 15/02*** | (2006.01) |
| ***F04B 7/02*** | (2006.01) |
| ***F04B 39/06*** | (2006.01) |

(52) U.S. Cl.

CPC ..... *F04B 15/02* (2013.01); *F04B 7/02* (2013.01); *F04B 15/023* (2013.01); *F04B 39/06* (2013.01); *F04B 2015/026* (2013.01)

(58) Field of Classification Search

CPC .. F04B 15/02; F04B 15/023; F04B 2015/026; F04B 7/02; F04B 13/00; F04B 39/06;

(Continued)

(56) References Cited

U.S. PATENT DOCUMENTS 1,455,272 A * 5/1923 Shavers ..... F16N 15/02 184/37
4,658,868 A * 4/1987 Word ..... B63B 27/24 114/256

(Continued)

FOREIGN PATENT DOCUMENTS

JP 05171628 A * 7/1993

OTHER PUBLICATIONS

Valve Check Inc (https://web.archive.org/web/20180118073236/http://www.valvecheckinc.com/check-valves.cfm, dated Jan. 18, 2018 (Year: 2018).*

(Continued)

*Primary Examiner* — Nathan C Zollinger
(74) *Attorney, Agent, or Firm* — Stinson LLP

(57) ABSTRACT

A high-viscosity fluid pumping system includes a reservoir defining an interior for holding a fluid and a pump assembly having an inlet and an outlet. The pump assembly includes a housing defining a chamber, a check valve and a piston. The inlet provides fluid communication between the interior of the reservoir and the chamber. The chamber is in fluid communication with the outlet. The check valve is positioned between and fluidly connected to the outlet and the chamber and permits the fluid to move from the chamber to the outlet. The piston is positioned in the chamber and moves from a retracted position, in which the chamber is in fluid communication with the inlet, and an extended position to move the fluid through the check valve to the outlet. At least one heater is provided to heat the fluid in at least one of the pump assembly and the reservoir.

20 Claims, 10 Drawing Sheets

(58) Field of Classification Search
CPC ..... B67D 1/0882; B67D 1/0884; B67D 1/00; B67D 7/02; B67D 7/0227; B67C 3/00; B67B 3/003
See application file for complete search history.

(56) References Cited

U.S. PATENT DOCUMENTS

| | | | | |
|---|---|---|---|---|
| 5,061,170 | A * | 10/1991 | Allen | D01D 1/04 425/197 |
| 5,915,593 | A * | 6/1999 | Bancon | B05C 11/10 222/41 |
| 8,936,135 | B2 | 1/2015 | Conley et al. | |
| 10,099,242 | B2 * | 10/2018 | Clark | B05C 11/1042 |
| 2003/0080156 | A1 * | 5/2003 | Jeter | B05C 11/1044 222/146.5 |
| 2005/0274740 | A1 * | 12/2005 | Duckworth | B05C 11/1042 222/146.5 |
| 2006/0011653 | A1 * | 1/2006 | Fontaine | G01G 13/24 222/181.1 |
| 2008/0095650 | A1 | 4/2008 | Divisi | |
| 2012/0132304 | A1 * | 5/2012 | Conley | F16N 29/02 137/565.17 |
| 2014/0117047 | A1 * | 5/2014 | Ross | F04B 49/24 222/146.2 |

OTHER PUBLICATIONS

English Machine Translation Abstract for JP-05171628-A (Year: 1993).*
English Machine Translation of JPH05171628 (Year: 1991).*

* cited by examiner

HIGH-VISCOSITY PUMPING SYSTEM

CROSS-REFERENCE TO RELATED APPLICATION

This application claims the benefit of U.S. Provisional Application No. 62/634,567, filed Feb. 23, 2018, the entirety of which is hereby incorporated by reference.

FIELD OF THE DISCLOSURE

The present disclosure generally relates to pumps, and more particularly to pumps constructed to move high-viscosity fluids.

BACKGROUND OF THE DISCLOSURE

Pumps are used to move a fluid through a system. For example, pumps are commonly used in a distribution system to move fluid from one location to another. Pumps have a wide variety of styles and types.

SUMMARY OF THE DISCLOSURE

In one aspect, a high-viscosity fluid pumping system comprises a reservoir defining an interior for holding a fluid, a pump assembly having an inlet and an outlet, and at least one heater configured to heat the fluid in at least one of the pump assembly and the reservoir. The pump assembly includes a housing defining a chamber. The inlet provides fluid communication between the interior of the reservoir and the chamber. The chamber is in fluid communication with the outlet. A check valve is positioned between and fluidly connected to the outlet and the chamber. The check valve is configured to permit the fluid to move from the chamber to the outlet. A piston is positioned in the chamber and configured to move from a retracted position, in which the chamber is in fluid communication with the inlet, and an extended position to move the fluid through the check valve to the outlet.

In another aspect, a method for pumping a high-viscosity fluid comprises heating a fluid contained in a reservoir with a heater. Pressurizing the fluid in the reservoir with a pressure, simultaneously with the heating of the fluid. Retracting a piston located in a chamber to form a vacuum in the chamber between a check valve and the piston as the piston is retracted. Moving, using the vacuum and the pressure, the fluid into the chamber from the reservoir when the piston reaches a retracted position in which the chamber is in open fluid communication with the fluid in the reservoir. Extending the piston to discharge the fluid through the chamber and check valve to an outlet.

Other objects and features will be in part apparent and in part pointed out hereinafter.

BRIEF DESCRIPTION OF THE DRAWINGS

Corresponding reference characters indicate corresponding parts throughout the drawings.

DETAILED DESCRIPTION

Figure 1:
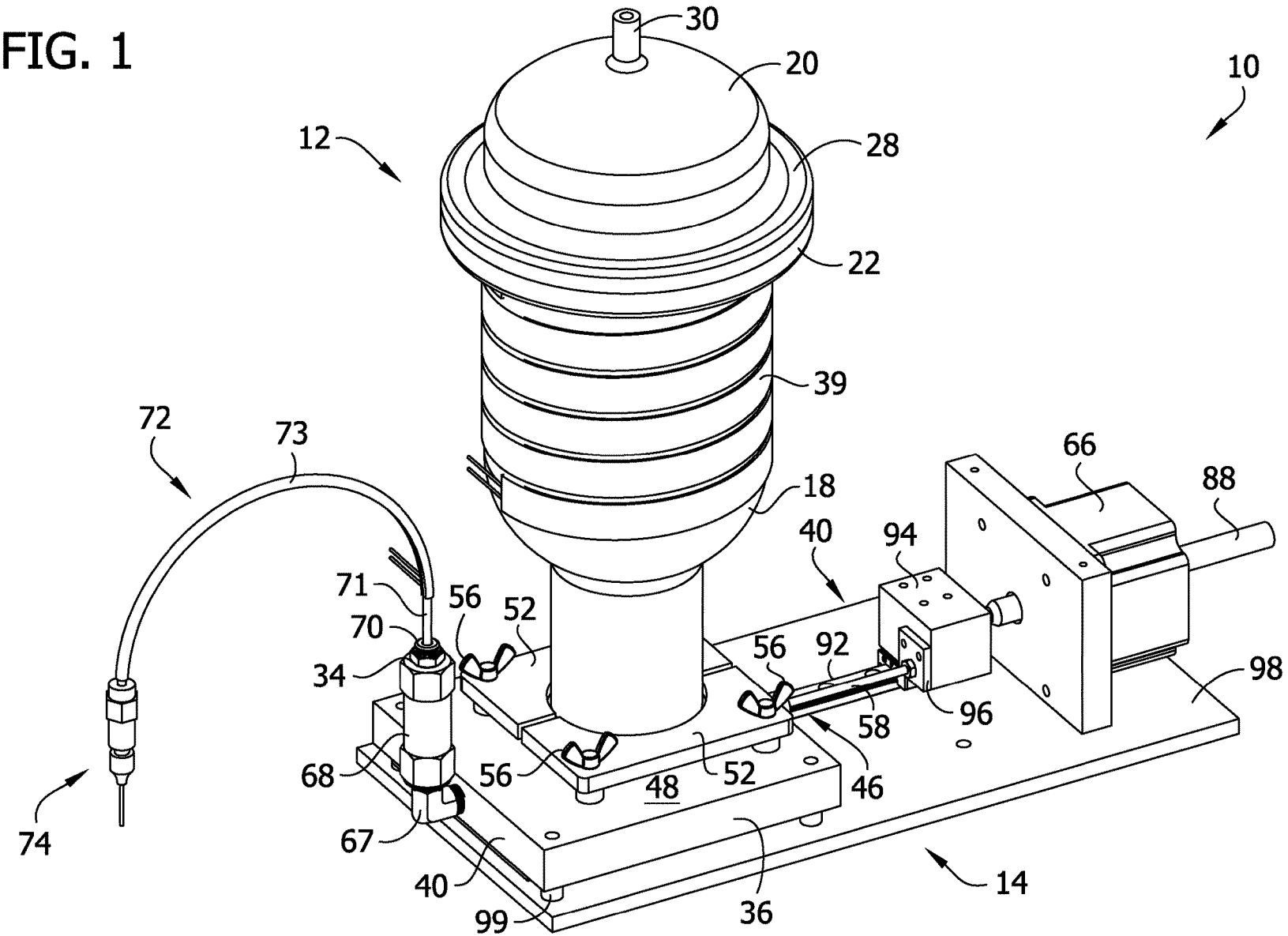
FIG. 1 is a front perspective of a high-viscosity pumping system of the present disclosure.

Referring to FIG. 1, a high-viscosity pumping system of the present disclosure is generally indicated at 10. The pumping system 10 heats fluid contained in a reservoir 12 to reduce the viscosity of the fluid and/or enhance the flowability of the fluid. As explained in more detail below, a pump assembly 14 of the pumping system 10 draws fluid from the reservoir 12 with a vacuum to dispense an uninterrupted (e.g., continuous) and unbroken supply of the fluid.

Figure 3:
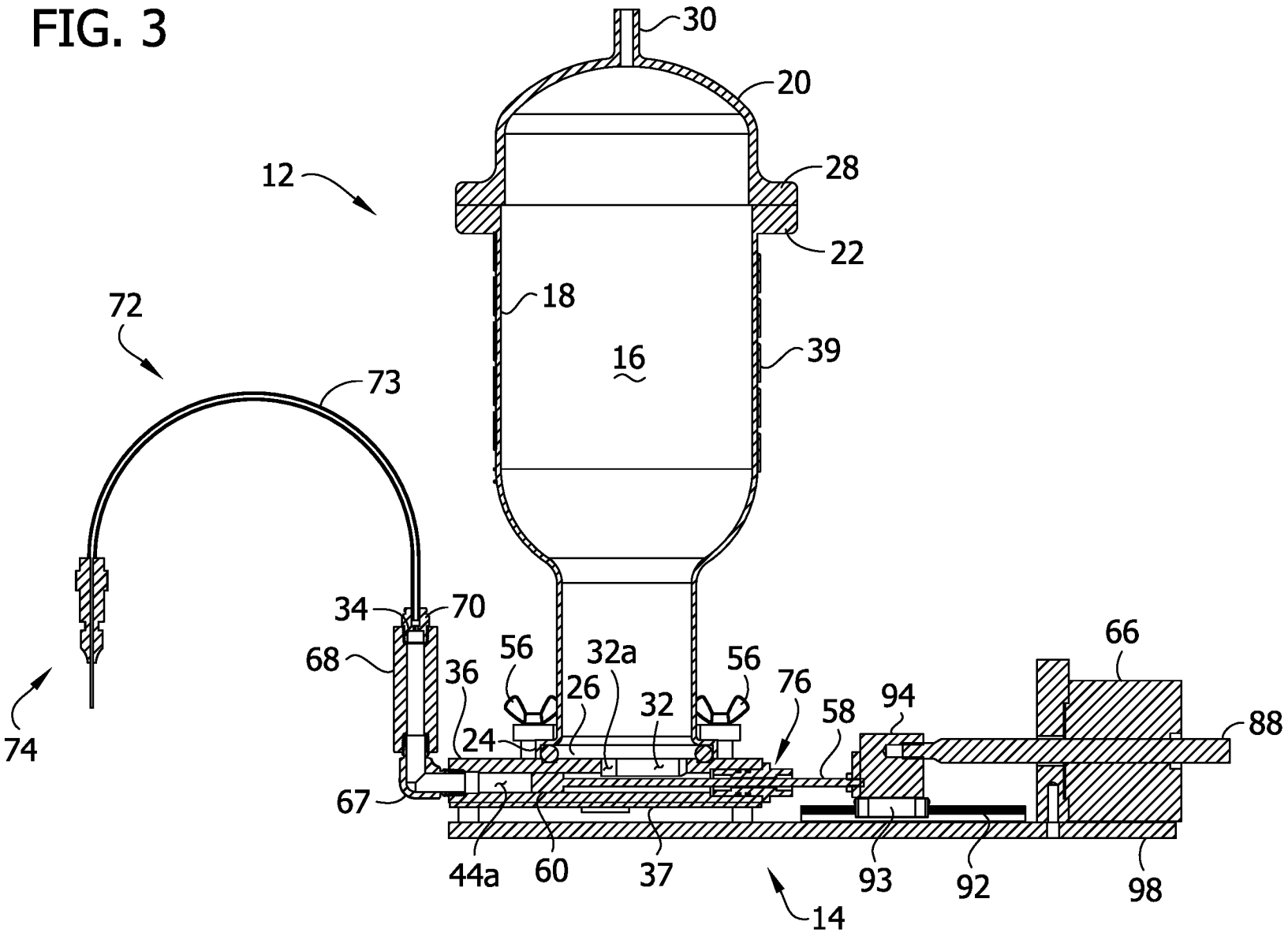
FIG. 3 is a cross sectional view of FIG. 1 taken parallel and through a chamber of the high-viscosity pumping system with a piston disposed between an extended position and a retracted position.
Figure 4:
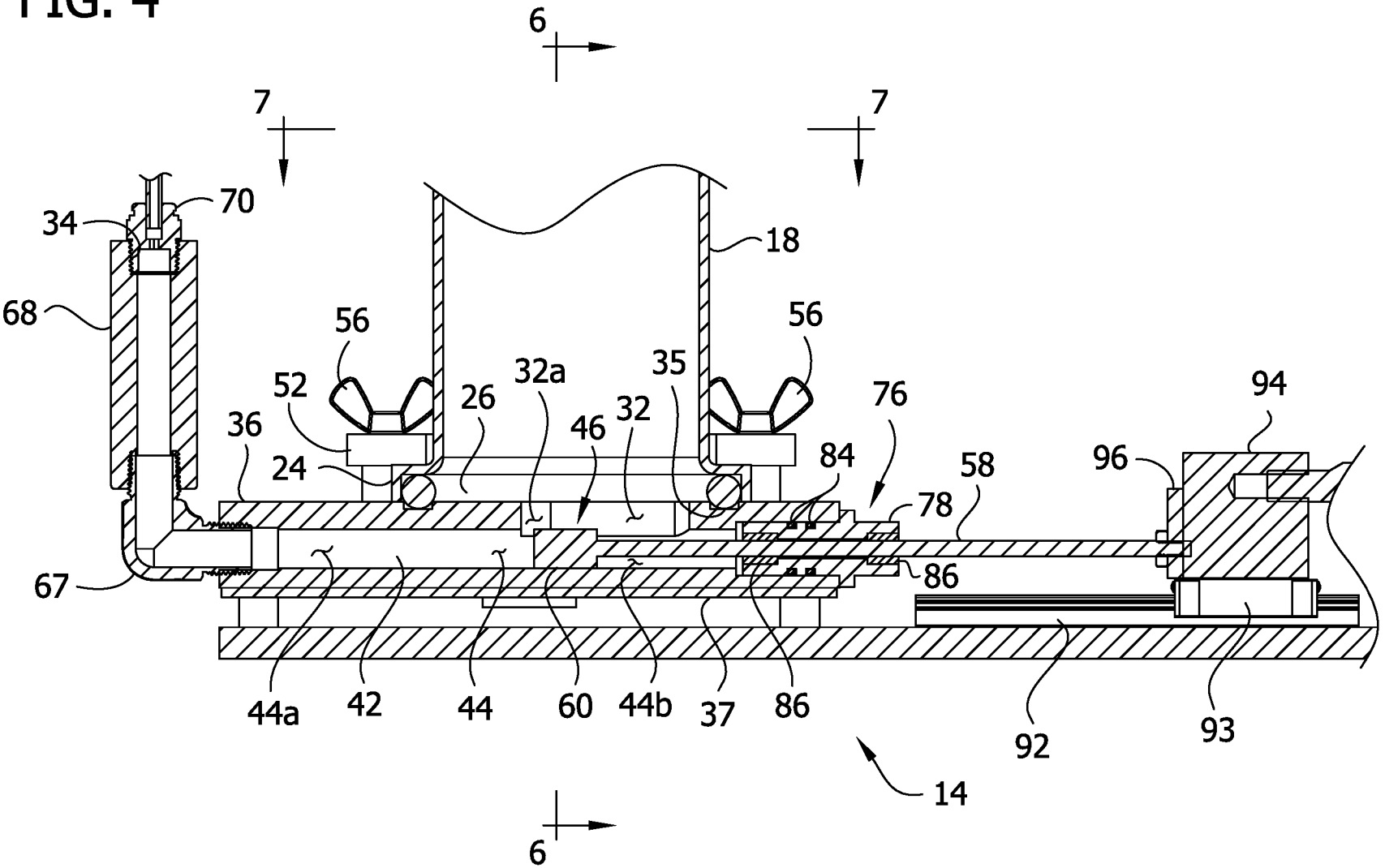
FIG. 4 is an enlarged, fragmentary view of FIG. 3 with the piston in the retracted position.
Figure 5:
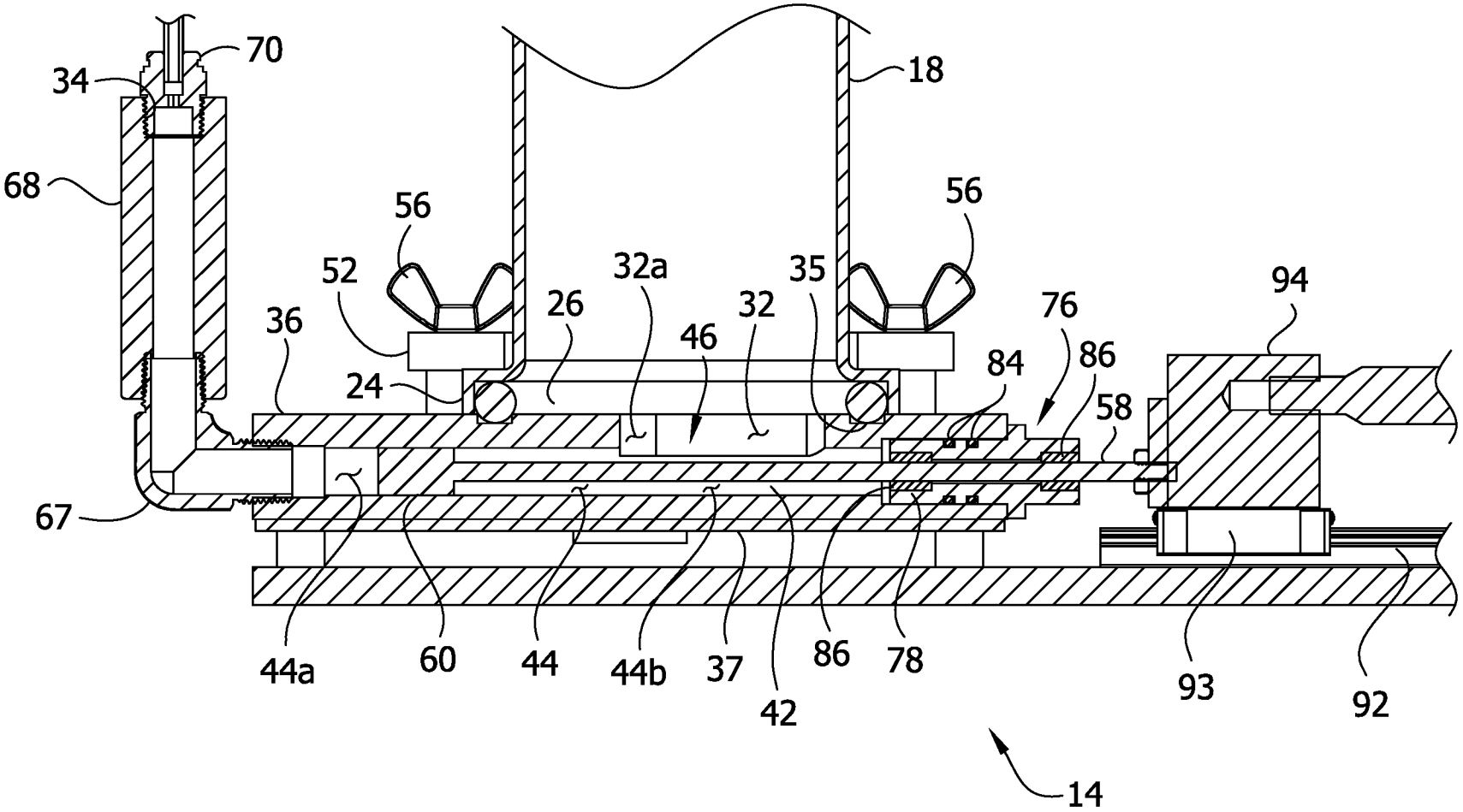
FIG. 5 is an enlarged, fragmentary view of FIG. 3 with the piston in the extended position.
Figure 6:
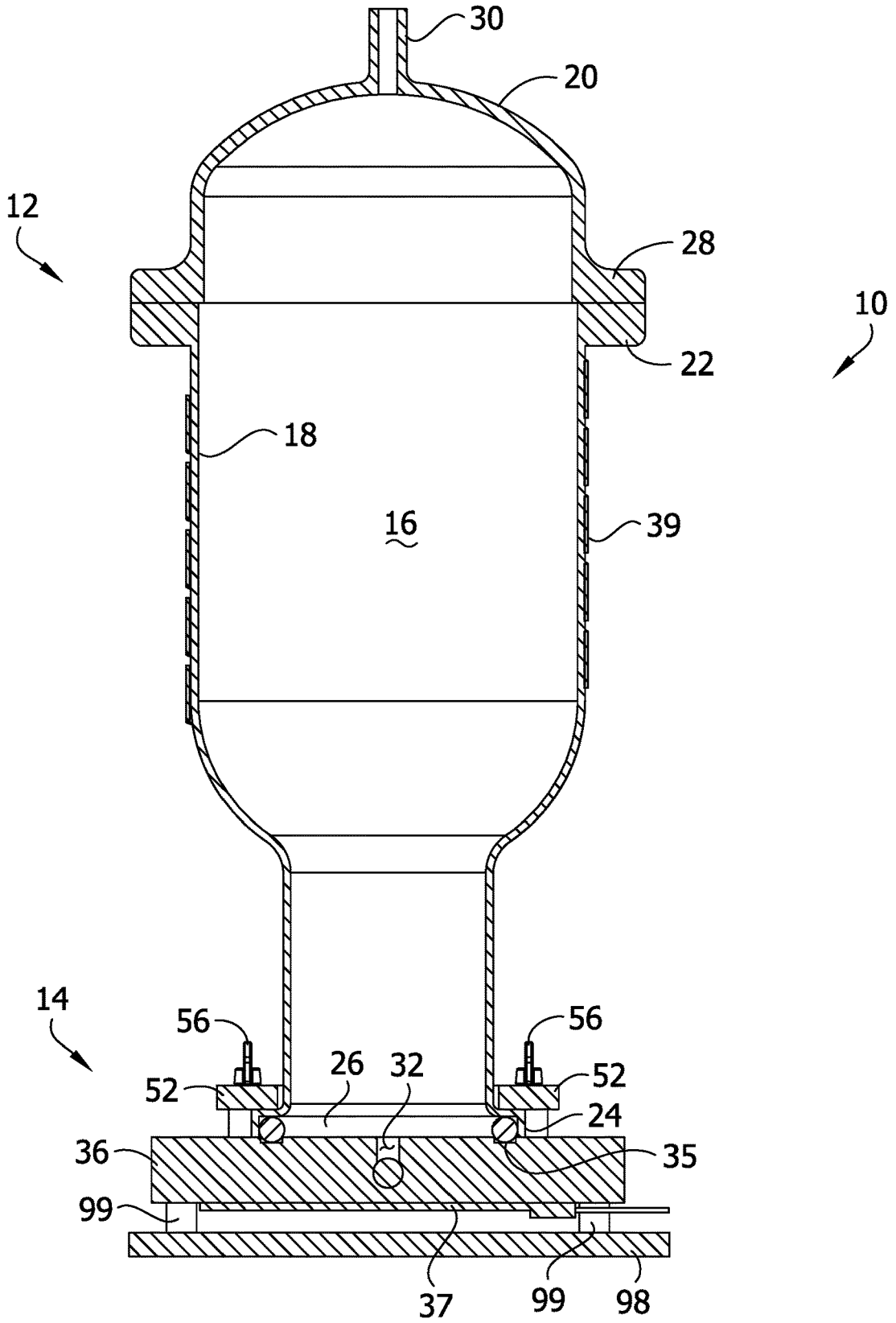
FIG. 6 is a cross sectional view of the high-viscosity pumping system in FIG. 1, taken through line 6-6 in FIG. 4.
Figure 7:
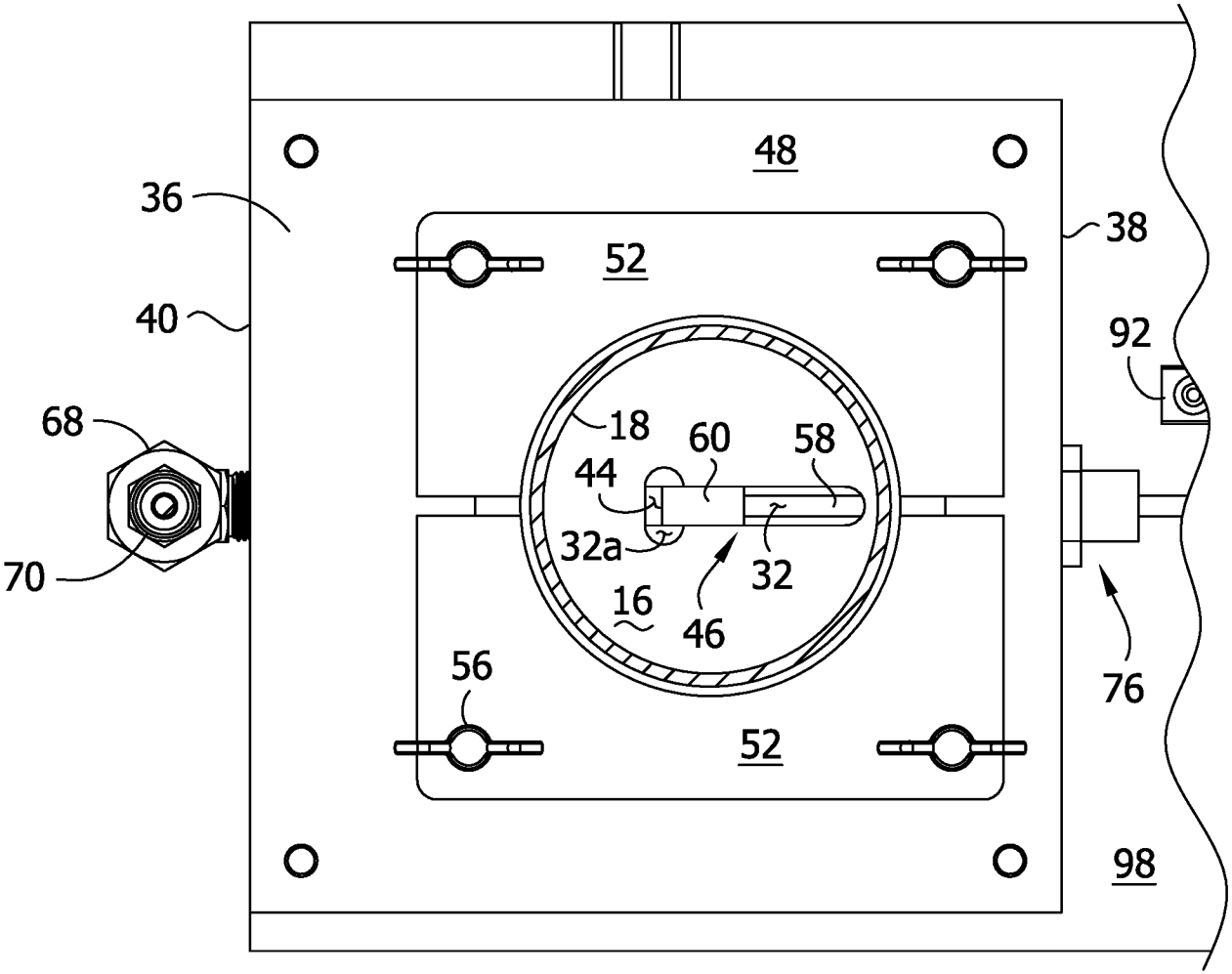
FIG. 7 is a cross sectional view taken through line 7-7 in FIG. 4.

Referring to FIGS. 1 and 3, the reservoir 12 of the pumping system 10 defines an interior 16 that receives and holds the fluid. The reservoir 12 includes a body 18 is generally cylindrical in shape with an open top and an open bottom. Bottom flange 24 extends outward from the bottom of the body 18. As explained in more detail below, the bottom flange 24 defines a space that receives a seal 26. In the illustrated embodiment, the bottom flange 24 is generally L-shaped. The seal 26 is a large rubber O-ring made of silicone, or any other suitable material. In the illustrated embodiment, the reservoir 12 includes an upper portion and a lower portion. The upper portion has a diameter that is greater than the lower portion. As explained in more detail below, the smaller diameter of the lower portion reduces the amount of waste In one embodiment, the reservoir 12 may include a lid 20 for the body 18 to close the interior 16 in order to allow the interior to be pressurized. As explained in more detail below, pressurizing the interior 16 facilitates the movement of the fluid through the pumping system 10. In this embodiment, the body 18 includes a top flange 22 extending outward from the top of the body. The top flange 22 may include a groove (not shown) thereon that receives a seal (not shown), such as seal 26. The lid 20 is configured to close the open top of the body 18. In the illustrated embodiment, the lid 20 has a dome shape. It is understood the body 18 and the lid 20 can have other shapes that are within the scope of the present disclosure. The lid 20 includes a lid flange 28 extending outward from the bottom of the lid. The lid flange 28 also includes a groove (not shown) thereon such that when the lid 20 closes the top of the body 18, the seal is received in the grooves of the lid flange and the top flange 22 of the body and compressed between the flanges to form a fluid and/or air tight seal between the lid and the body. Other ways of forming a fluid and/or air tight seal between the lid 20 and body 18 are within the scope of the present disclosure. In the illustrated embodiment, the lid 20 is configured to be clamped to the body 18 to close the top of the body, however, other ways of attaching the lid to the body are within the scope of the present disclosure. The lid 20 may include a pressure fitting 30 defining an opening in fluid communication with the interior 16. As described in more detail below, the pressure fitting 30 is configured to be connected to a pressure source (not shown) to pressurize the fluid held in the reservoir 12. The body 18 and lid 20 of the reservoir 12 can be made of glass, steel or any other suitable material. In the preferred embodiment, the reservoir 12 is made of glass to permit a person to view of the contents of the reservoir.

The pumping system 10 may include one or more heaters configured to heat the various components and surfaces that come into contact with the fluid moved by the pumping system, for reasons that will become apparent. In other words, the pumping system 10 may include one or more heaters that directly and/or indirectly heat one or more components of the pumping system in order to indirectly heat the fluid within the pumping system (e.g., the one or more heaters do not directly heat the fluid). In one embodiment, the reservoir 12 may be heated using a reservoir heater 39. In the preferred embodiment, the reservoir heater 39 is a heating tape or ribbon surrounding the reservoir 12 and can heat the reservoir to a temperature above room temperature. For example, in one embodiment, the reservoir heater 39 can heat the reservoir 12 to a temperature of at least 60° C. (140° F.) or more. Preferably, the reservoir heater 39 is heating ribbon (e.g., heating tape) wrapped around at least a portion of the exterior of the reservoir 12. In the illustrated embodiment, the heating ribbon 39 is wrapped around the upper portion of the reservoir 12 (FIG. 1), although other configurations are within the scope of the present disclosure. For example, heating ribbon 39 may wrap around generally the entire reservoir 12 or only wrap around the lower power of the reservoir. The heating ribbon 39 may be attached to the reservoir 12 by any suitable method, such as by an adhesive. An example of a suitable heating ribbon is the Heating Tape, part no. 103A DET0.56 available from Glas-Col, www.glascol.com, however, it is understood that any heater able to heat the reservoir may be used and is within the scope of the present disclosure. For example, the reservoir heater may be a heating jacket such as the GF Silicone Construction Heating Jackets available from Glas-Col, www.glascol.com.

Referring to FIGS. 1-5, the pump assembly 14 of the pumping system 10 has an inlet 32 and an outlet 34. The pump assembly 14 receives the fluid contained in the reservoir 12 through the inlet 32 and moves the fluid to the outlet 34. Various connections can be made with the outlet 34 to further direct the pumped fluid to another location. The pump assembly 14 includes a generally rectangular plate or housing 36 having opposite first and second edge margins 38 and 40, respectively, and opposite upper and lower surfaces 48 and 50, respectively. The reservoir 12 engages and is supported by the upper surface 48 of the housing 36 such that the open bottom of the body 18 is adjacent the housing. The housing 36 includes a groove 35 on the upper surface 48 configured to receive a seal 26 such that when the reservoir 12 is secured to the pump assembly 14, the seal is received in the space defined by the bottom flange 24 and the groove. In this arrangement, the seal 26 engages and is compressed between the upper surface 48 of the housing 36 and the bottom flange 24 of the body 18 to form a fluid and/or air tight seal between the reservoir and the housing. In the illustrated embodiment, the seal 26 between the reservoir 12 and the pump assembly 14 is identical to the seal between the lid 20 and the body 18 of the reservoir, described above. To removably secure the reservoir 12 to the pump assembly 14, the reservoir 12 is clamped to the housing 36 with clamp brackets 52. Fasteners 56, such as wing nuts having threaded shafts, extend through the clamp brackets 52 and into threaded openings in the housing 36 to clamp the reservoir 12 to the housing. It is understood that other configurations connecting the reservoir 12 to the pump assembly 14 are within the scope of the present disclosure. The housing 36 is made of metal such as stainless steel, aluminum or any other suitable material.

Figure 8:
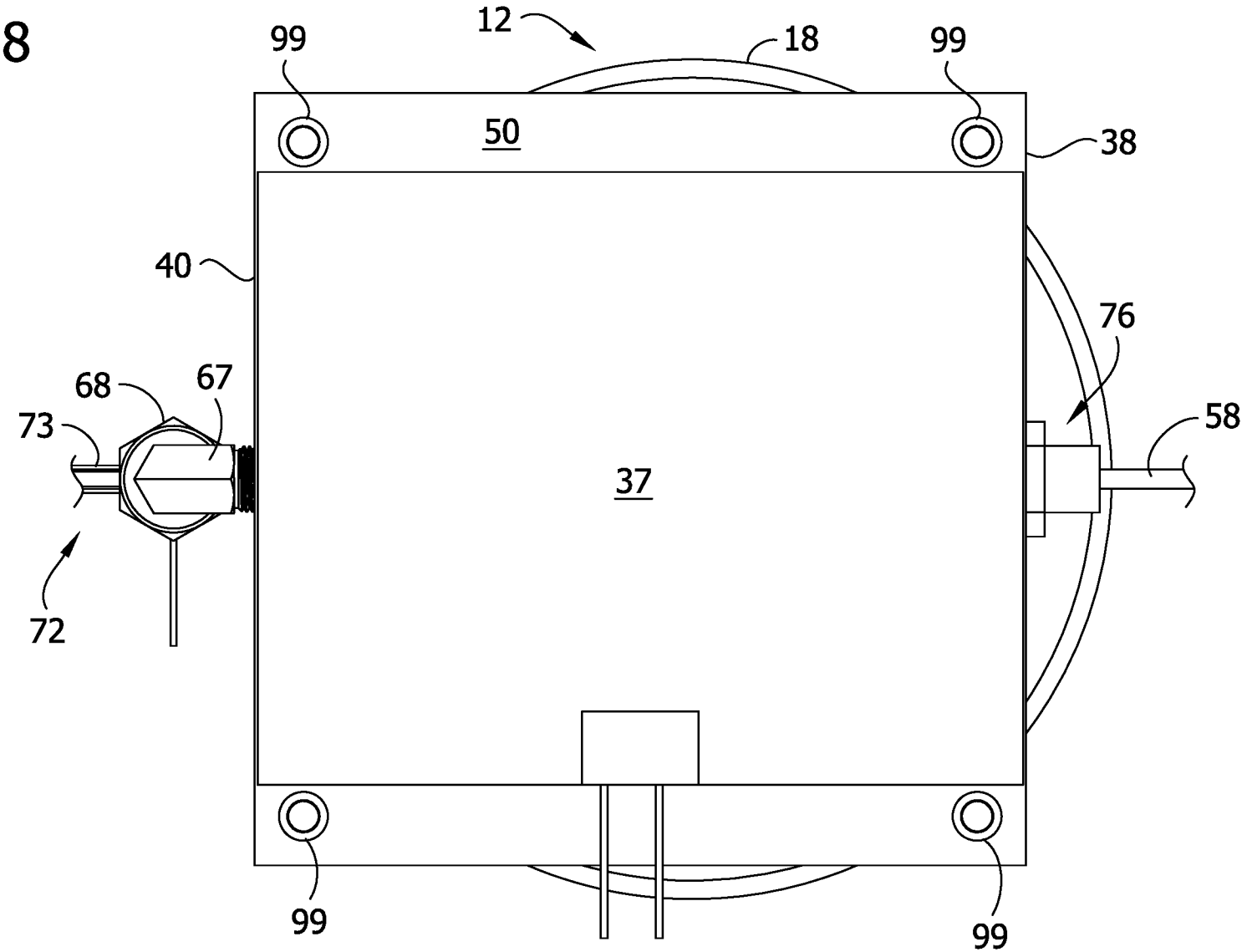
FIG. 8 is an enlarged, fragmentary bottom view of the high-viscosity pumping system with a platform of the system removed.
Figure 9:
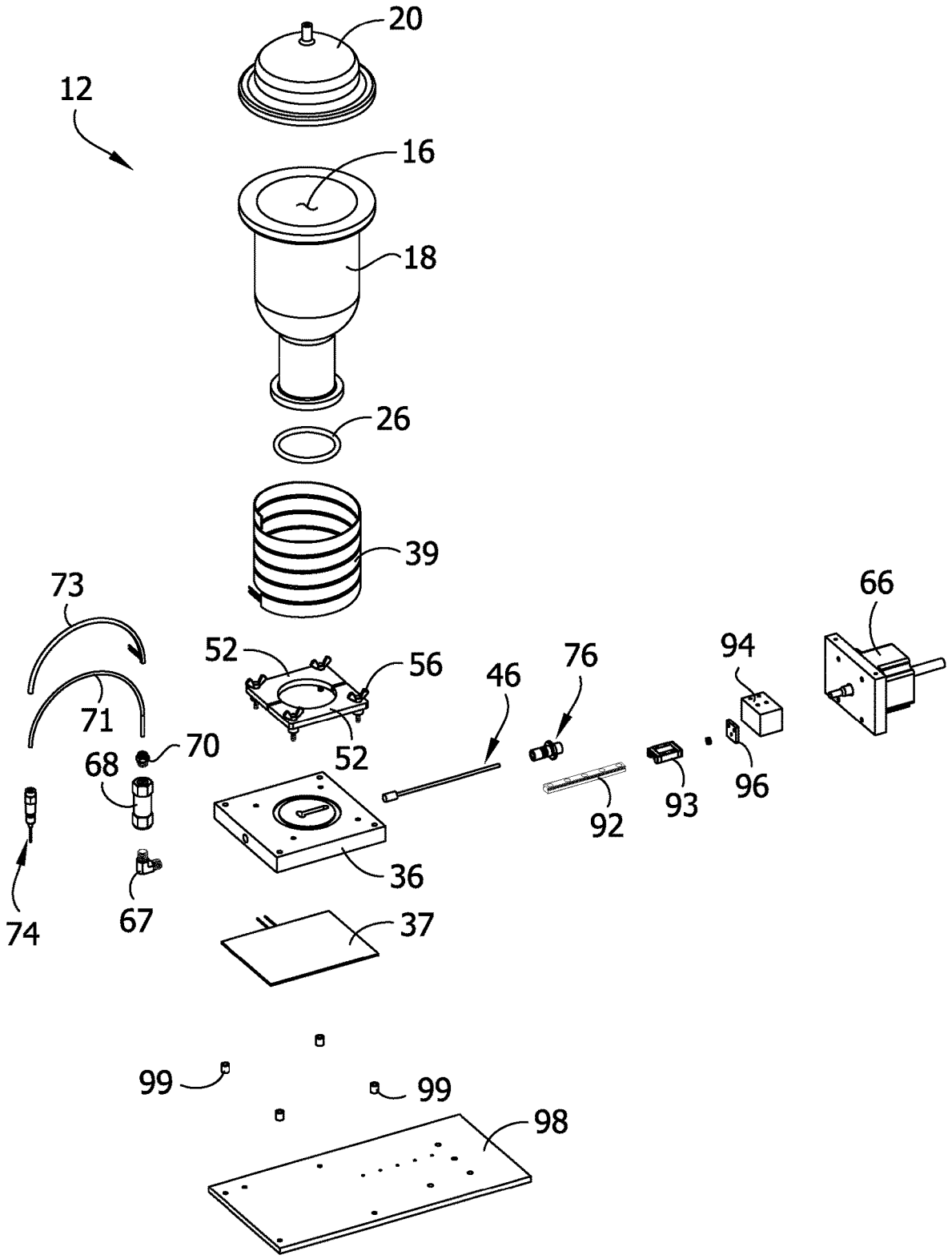
FIG. 9 is an exploded perspective of FIG. 1.

The housing 36 may be heated by a pump assembly heater 37 (FIG. 8). The pump assembly heater 37 engages the lower surface 50 the housing 36 and heats the housing, and thereby any fluid contained within. The pump assembly heater 37 and reservoir heater 39 heat the reservoir 12, the housing 36 and the fluid contained therein to the same or similar temperatures. In the preferred embodiment, the pump assembly heater 37 can heat the housing 36 to the same temperature as supplied by the reservoir heater. For example, the pump assembly heater can heat the housing 36 to a temperature of at least 60° C. (140° F.) or more. In the illustrated embodiment, the pump assembly heater 37 is a heating pad. One example of a suitable pump assembly heater 37 is the Etched Foil Element Silicone Rubber Heater, part number F030050C8, available from Watlow, www.watlow.com. It is understood that additional heaters can be incorporated into the pumping system 10 to heat various parts or individual components of the pumping system. In one example, for reasons that will become apparent, every surface of the pump assembly 10 that contacts the fluid is heated by a heater. It is understood that components not directly heated by a heater may be indirectly heated through their contact with components that are directly heated.

Referring to FIGS. 1-6, the housing 36 has an interior surface 42 defining a chamber 44 for receiving and holding fluid therein. The chamber 44 is in fluid communication with the inlet 32 and the outlet 34. The chamber 44 has a proximal end at the first edge margin 38 and a distal end at the second edge margin 40. The chamber 44 is cylindrical in shape (cross-section). The inlet 32 extends through housing 36 from the upper surface 48 to the chamber 44. The chamber 44 has a discharge portion **44*a* and an inlet portion 44*b*. As will be described in more detail below, the inlet portion 44*b* receives the fluid from the reservoir 12 and the discharge portion 44*a* receives the fluid from the inlet portion. The inlet 32 provides fluid communication between the interior 16 of the reservoir 12 and the chamber 44. In the illustrated embodiment, the inlet 32 is a slot extending above the inlet portion 44*b* of the chamber 44. The slot 32 is in continuous open fluid communication with the chamber 44 and the interior 16 of the reservoir 12. The slot 32 has opposite side edge margins generally parallel to the chamber 44 and a width extending between the opposite side edge margins, the width of the slot being less than a diameter of the chamber. The smaller diameter of the lower portion of the reservoir 12 focuses and directs the majority of the fluid into contact with the slot 32 while minimizing the amount of fluid that does not flow into the slot and remains on top of the housing 36 when the reservoir is generally empty. In one embodiment, the slot 32 has a wider section 32*a* at the end of the slot adjacent the discharge end 44*a*. The wider section 32*a* has a width greater than the width of the rest of the slot 32. Preferably, the wider section 32*a* has a width greater than the diameter of the chamber 44. The wider section 32*a* of the slot 32 make it easier for fluid to flow from the reservoir, through the slot and into the discharge portion 44*a* of the chamber 44**.

As shown in FIG. 8, the pump assembly heater 37, if included, is disposed on the housing 36 such that the pump assembly heater is underlies or is directly below (e.g., vertically aligned with) the chamber 44 in order to ensure the pump assembly heater heats the interior surface 42 defining the chamber to the appropriate temperature. Preferably, the pump assembly heater 37 extends along the housing 36 and underlies the entire or nearly the entire chamber 44 in order to heat the entire chamber. In the illustrated embodiment, the pump assembly heater 37 generally extends from and between each edge margin 38, 40 of the housing 36.

The pump assembly 14 includes a piston 46 received in the chamber 44. The piston 46 includes a shaft 58 with a proximal and distal end, and a piston head 60 secured to the distal end of the shaft. The piston head 60 sealingly engages the interior surface 42 of the housing 36 and is slidable within the chamber 44 to dispense fluid through the distal end of the chamber (generally the chamber outlet) as the piston moves distally in the chamber from a retracted position (FIG. 4) to an extended position (FIG. 5), as described in more detail below. More specifically, the piston head 60 is in an extremely close fitting relationship with the chamber 44 that the piston head sealingly engages the interior surface 42. Thus, in the illustrated embodiment, no sealing structure or material is included on the piston head 60. In other words, the piston head 60 engages the interior surface 42 defining the discharge portion 44*a* of the chamber 44 such that a fluid and/or air tight seal is formed between the piston head and the housing 36. In other embodiments, the piston head 60 may include a sealing structure or material to sealingly engage the interior surface 42, such as one or more O-rings.

Referring to FIGS. 2-5 and 9, the pump assembly 17 includes a shaft seal assembly 76. The shaft seal assembly 76 is secured to the housing 36 and closes the proximal end of the chamber 44. The shaft seal assembly 76 includes a barrel 78 that is sized and shaped to be removably received in the chamber 44. A barrel flange 80 extends outward from the barrel 78. When the shaft seal assembly 76 is inserted into the chamber 44, the barrel flange 80 engages the first edge margin 38 of the housing 36. Fasteners (not shown) extend through the barrel flange 80 and into threaded openings in the housing 36 to removably secure the shaft seal assembly 76 to the housing. Shaft seal assembly 76 includes at least one seal 84 on the circumference of the barrel 78. The at least one seal 84 engages the interior surface 42 defining the chamber 44 such that a fluid and/or air tight seal is formed between the barrel 78 and the housing 36. In the preferred embodiment, the shaft seal assembly 76 includes at least two seals 84. One example of a suitable seal 84 is the High-Temperature Silicone O-Rings, part number 5233T34, available from McMaster-Carr, www.mcmaster.com. The barrel 78 defines a cylindrical opening extending lengthwise between opposite ends of the barrel. The shaft 58 of the piston 46 is received in the opening of the barrel 78 and is slidable within the opening. A cup seal (not shown) located in the opening engages the barrel 78 and the shaft 58 of the piston such that a fluid and/or air tight seal is formed between the barrel and the shaft. One example of a suitable cup seal is the style 870 U-seals, part number 870-006, available from All Seals Inc., www.allsealsinc.com. The combination of the at least one seal 84 and the cup seal of the shaft seal assembly 76 closes the proximal end of the chamber 44 while permitting the shaft 58 of the piston 46 to slide in an out of the chamber. Each end of the barrel 78 includes a bushing 86 defining an end of the cylindrical opening. The shaft 58 of the piston 46 engages the bushings 86 and slides thereon.

The pump assembly 14 includes a check valve 68 secured to the housing 36. The check valve 68 is positioned between and fluidly connected to the outlet 34 and the chamber 44. More specifically, the check valve 68 is secured to the second edge margin 40 of the housing 36 at the distal end of the chamber 44. As appreciated by one skilled in the art, a check valve only permits fluid to move through the valve in one direction. The check valve 68 is oriented such as to permit fluid to move from the chamber 44, through the check valve and towards the outlet 34 as the piston 46 moves from the retracted position to the extended position, as described in more detail below. In the illustrated embodiment, a connection fitting 67, as an elbow fitting, connects the check valve 68 to the housing 36. Other ways of connected the check valve 68 to the housing 36 are within the scope of the present disclosure. For example, the check valve 68 can be directly attached to the housing 36. One example of a suitable check valve is the 6300-1PP Check Valve, part number 6324-5-1PP-2, available from Valve Check, Inc., www.valvecheckinc.com, with a cracking pressure (the pressure required to open the check valve to move fluid through the check valve in the one direction) of 2 psi (13.8 kPa). If the reservoir 12 is pressurized, the check valve 68 has a cracking pressure greater than the pressure applied to the reservoir so that the check valve does not open under the pressure applied to reservoir. However, it is understood the check valve 68 can have a lower cracking pressure, such as 0.5 psi (3.5 kPa), or a higher cracking pressure, such as 100 psi (689 kPa), depending on the fluid's characteristics and the pressure, if any, applied to the reservoir 12. The check valve 68 can define the outlet 34 of the pump assembly or in a different variation, a connection fitting 70 can be secured to the check valve and define the outlet of the pump assembly. In either variation, the outlet 34 of the pump assembly 14 is configured to be attached to additional components that transport the fluid to a separate location as the fluid is moved by the pump assembly. In the illustrated embodiment, the connection fitting 70 is configured to be connected to a proximal end of a heated supply line 72. An injection outlet 74 is connected to the distal end of the heated supply line 72 to dispense fluid therefrom. In the illustrated embodiment, the injection outlet 74 is needle shaped to dispense fluid into containers, as described in more detail below. The heated supply line 72 includes a conduit 71 for transporting fluid from the outlet 34 to the injection outlet 74 and a heating wrapper 73 (broadly, a heater) surrounding the conduit. For reasons that will become apparent, the heating wrapper 73 maintains the temperature of the fluid from the pump assembly 14 at the same temperature as the pump assembly heater 37 and the reservoir heater 39. In the preferred embodiment, the heating wrapper 73 can heat the heated supply line 72 to the same temperature as supplied by the reservoir heater 37. For example, the heating wrapper can heat the heated supply line 72 to a temperature of at least 60° C. (140° F.) or more.

Figure 2:
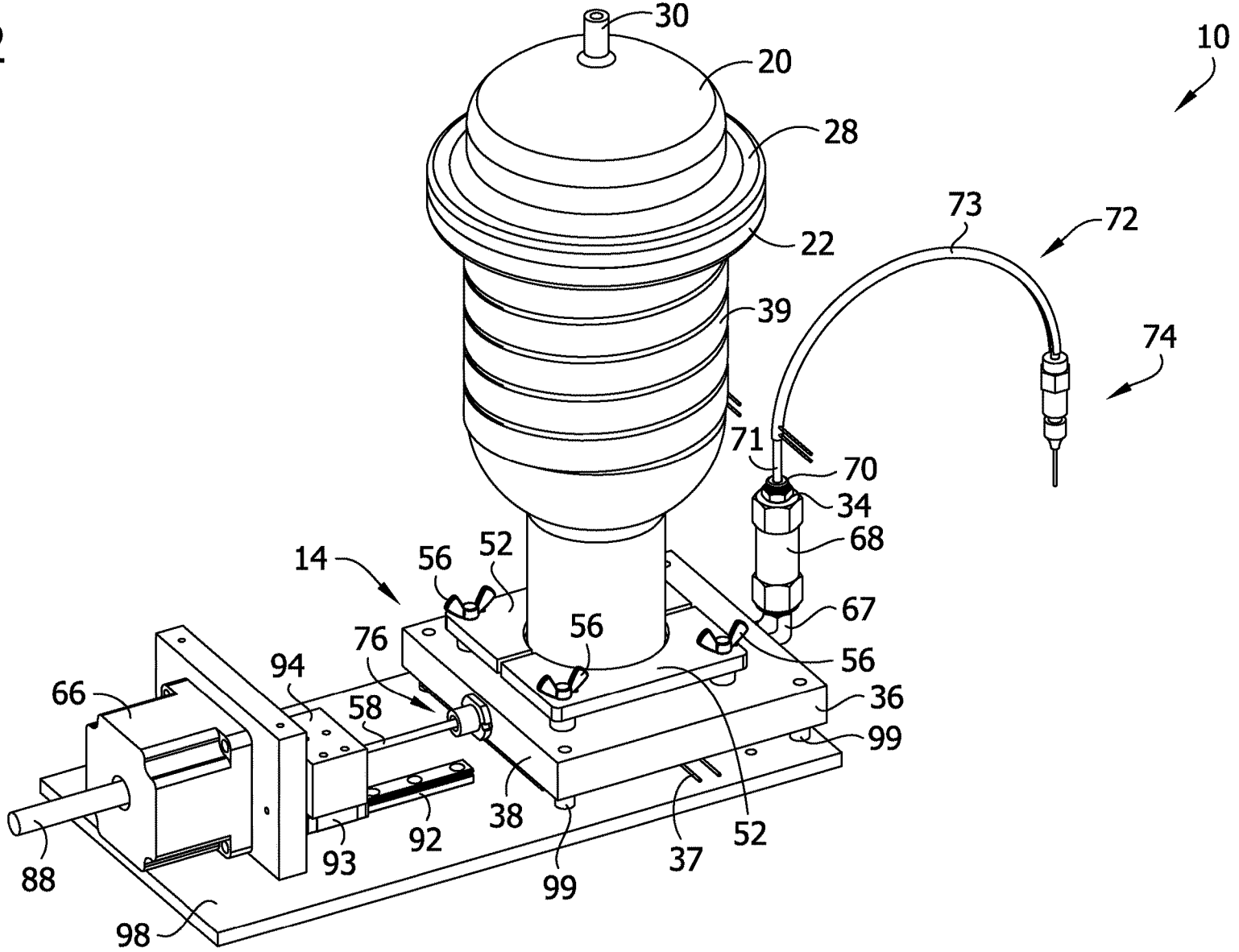
FIG. 2 is a rear perspective of the high-viscosity pumping system.

Still referring to FIGS. 1-3, the pump assembly 14 includes a driver 66 operatively connected to the piston 46. As described in more detail below, the driver moves the piston 46 in the chamber 44 between the retracted and extended positions. In the preferred embodiment, the driver 66 is a linear stepper motor, however, any positional driver that can move between known or set positions, such as a servo motor, is within the scope of the present disclosure. One example of a suitable linear stepper motor 66 is the Non-Captive Lead Stepper Motor, part number 23AW1043X12-LW8-NC, available from Anaheim Automation, www.anaheimautomation.com. The linear stepper motor 66 includes a motor shaft 88. The linear stepper motor 66 axially moves the motor shaft 88. The driver 66 is controlled by a controller (not shown), such as a computer, that can operate the driver.

The pump assembly 14 includes a slide assembly 90 operatively connecting the piston 46 and the driver 66. The slide assembly 90 includes a rail 92, a rail car 93 connected to and slidable along the rail, and a transfer block 94 secured to the rail car. One example of a suitable rail and rail car is the Mini-Rail system, part number MR9, available from PBC Linear, www.pbclinear.com. To operatively connect the linear stepper motor 66 to the piston 46, one end of the motor shaft 88 is connected to transfer block 94 and the proximal end of the shaft 58 is connected to the transfer block. To move the piston 46, the linear stepper motor 66 moves the motor shaft 88 to slide the transfer block 94 along the rail 92. As the transfer block 94 slides along the rail 92, the transfer block moves the piston 46. The transfer block 94 includes a transfer plate 96 that connects the proximal end of the shaft 58 of the piston 46 to the transfer block. The transfer plate 96 prevents the piston 46 from binding as the linear stepper motor 66 moves the piston in the chamber 44. The housing 36, rail 92 and linear stepper motor 66 are removably secured to and supported by a platform 98. Preferably, spacers 99 are disposed between the platform 98 and the housing 36 to space apart the housing from the platform to provide space for the pump assembly heater 37. Fasteners (not shown), such as bolts, extend through the housing 36, spacers 99 and into threaded openings in the platform 98 to removably mount the housing to the platform. The pump assembly 14 can include a limit switch (not shown) mounted on the platform 98 such that the limit switch is engaged by the transfer block 94 when the transfer block, and therefore the piston 46, is in a specific location. The limit switch is can be connected to the linear stepper motor 66 or the controller. The limit switch can be used to operate the linear stepper motor 66 such as by stopping the linear stepper motor when the limit switch is engaged by the transfer block 94. The limit switch can also be used to calibrate the position of the linear stepper motor 66 by sending a signal to the controller when engaged by the transfer block 94.

The high-viscosity pumping system 10 can pump or move fluids that are solid or nearly solid at room temperature (70° F.; 21° C.) with viscosities of 100,000 cP (100,000 mPa-s) or greater. For example, fluids that are solid or nearly solid at room temperature may have nearly infinite viscosities at room temperature. To pump such fluids, the fluids must first be heated so that the fluid softens or melts into a more flowable state. Generally, a fluid's viscosity decreases as the fluid is heated (i.e. the fluid has less resistance to flow and is more flowable). In one example, the high-viscosity pumping system 10 can be used to pump pure or distilled tetraydrocannabinol (THC), cannabidiol (CBD) or other cannabinoid mixtures. THC (commonly referred to as clear, glass or shatter in the cannabis industry) mixtures are generally honey like at room temperature (i.e. distilled THC has an extremely large viscosity at room temperature) and, depending upon the purity, become flowable at approximately 50° C. (122° F.). For example, in terms of purity, 95% pure THC is unflowable at room temperature whereas 50% pure THC is flowable at room temperature. At 50° C. (122° F.), distilled 95% pure THC has a viscosity of approximately 2000 cP (2000 mPa-s). It is understood that the pumping system 10 described herein is not limited to pumping or moving the fluids described herein and that the pumping system may be used to pump or move any fluids that are solid or near solid at room temperature. Furthermore, it is understood that the pumping system 10 can also be used to move lower viscosity fluids that are liquid at room temperature, such as water having a viscosity of 1 cP (1 mPa-s). In this example, it is understood that it is not necessary to heat the water because water is in a flowable state at room temperature.

To operate the high-viscosity pumping system 10, the fluid is placed in the reservoir 12 and the lid 20 is closed. The reservoir heater 39 heats the fluid to a desired temperature at which the fluid is generally liquid and flows (flowable state). When the pumping system 10 is filled with distilled THC, the desired temperature is 60° C. (140° F.), a temperature at which the distilled THC will melt and have the viscosity of approximately 2000 cP (2000 mPa-s). If desired and included in the pumping system 10, the connection fitting 30 is fluidly connected to a pressure source, such as an air compressor, to pressurize the reservoir 12. Placing the fluid under pressure facilitates the movement of the fluid through the pumping system 10, as described in more detail below. In one embodiment, the pressure source may pressurized the reservoir 12 to a pressure between 15 to 30 psi (103 to 206 kPa). Once the fluid is in the flowable state, the fluid can move from the interior 16 of the reservoir 12 through the inlet 32 and into the chamber 44 of the housing 36. To maintain the fluid in the flowable state in the housing 36, the pump assembly heater 37 heats the housing to keep the fluid at the desired temperature. Thus, the reservoir heater 39 and pump assembly heater 37 heat the reservoir 12 and housing 36, respectively, to the same or similar temperature to place and/or maintain the fluid in the flowable state so that the fluid can be moved by the pump assembly. If the fluid is not maintained in the flowable state (i.e. the fluid is allowed to cool and solidify) the pump assembly 10 may be unable to move the fluid (depending upon the fluid's viscosity).

The driver 66 operates the piston 46, by moving the transfer block 94 along the rail 92, to move the fluid from the reservoir 12 to the outlet 34. The piston 46 moves between the retracted position, shown in FIG. 4, and the extended position, shown in FIG. 5, to pump the fluid. In the retracted position, the piston head 60 is positioned in the inlet portion 44*b* of the chamber 44. In this position, the piston head 60 does not separate the discharge portion 44*a* and the inlet portion 44*b* of the chamber 44 such that the discharge portion is in open fluid communication with the reservoir 12. Preferably, in the retracted position the distal end of the piston head 60 is either disposed in (e.g., aligned with) the wider section 32*a* of the slot 32 or located proximally of the wider section. In the illustrated embodiment, the piston head is approximately ½ inch from the distal end of the inlet slot 32 in the retracted position, however, other positions are within the scope of the present disclosure. In the extended position, the piston head 60 is positioned in the discharge portion 44*a* of the chamber 44.

To move fluid to the outlet 34, the piston, in the retracted position, is moved distally by the driver 66 such that the piston head moves distally into the discharge portion 44*a* of the chamber 44. As the piston head 60 moves distally, the piston head moves into the discharge portion 44*a*, sealingly reengages the interior surface 42 in the discharge portion of the chamber 44. Once the piston head 60 sealingly engages the housing 36, as the piston 46 is moved distally to the extended position, the piston head 60 pushes the fluid contained in the discharge portion 44*a* through the check valve 68 and toward the outlet 34 (the piston pressurizes the fluid in the chamber above the cracking pressure of the check value so that the fluid moves through the check valve). From the extended position, the piston 46 is moved proximally by the driver 66 into the inlet portion 44*b* of the chamber 44. As the piston head 60 moves proximally (FIG. 3) from the extended position, a vacuum is formed in the discharge portion 44*a* of the chamber 44 between the check valve 68 and the piston head. The vacuum forms because the check valve creates a first closed end by preventing any material, such as the fluid and/or air, from being drawn proximally back into the chamber 44 and the piston head 60 creates a second closed end by sealingly engaging the interior surface 42 of the chamber 44. In the retracted position, the discharge portion 44*a* is in open fluid communication with the reservoir 12 (via the inlet portion 44*b* and inlet 32), exposing the fluid in the reservoir to the vacuum. The vacuum draws the fluid from the reservoir 12 into the discharge portion 44*a* of the chamber 44. At the same time, gravity (as the fluid is held directly above the inlet 32) pulls the fluid into the discharge portion 44*a*. In other words, as soon as the seal between the piston head 60 and interior surface 42 is broken, the combination of the vacuum and gravity moves the fluid from the interior 16 of the reservoir into the discharge portion 44*a* of the chamber 44 (i.e. fluid is moved distal of the piston head). The vacuum ensures the discharge portion 44*a* of the chamber 44 is completely filled with fluid. If the reservoir 12 is pressurized, at the same time as the vacuum is drawing fluid into the discharge portion 44*a*, the pressure in the reservoir 12 pushes the fluid into the discharge portion 44*a*. It is understood that the pressure is not required and the vacuum is sufficient to fill the entire discharge portion 44*a* with fluid without the reservoir being pressurized.

After fluid from the reservoir 12 has moved distal of the piston head 60 and filled the discharge portion 44*a* of the chamber 44, the driver 66 moves the piston 46 to the extended position, repeating the process. This process is repeated (i.e. the piston is moved back and forth between the extended and retracted positions) to move additional fluid from the reservoir 12 to the outlet 34. Since the driver 66 can selectively position the piston 46, the exact position of the piston head 60 in the discharge portion 44*a* of the chamber 44 (the extended position) can vary based on the amount of fluid to be dispensed. In other words, the driver 66 is configured to move the piston different distances from the retracted position (specifically, from the intersection of the discharge portion 44*a* and inlet portion 44*b*—the point where the piston head 60 sealingly engages with the interior surface 42 of the discharge portion) toward the extended position to dispense different amounts of fluid through the outlet. The amount of fluid dispensed corresponds to the distance the piston 46 is moved by the driver 66. The distance and corresponding amount of fluid that can be dispensed is variable and can be set by an operator using the controller. Accordingly, the amount or volume of fluid dispensed by the pumping system 10 can vary and the operator, via the controller, can control the amount of fluid dispensed. In one embodiment, the extend position corresponds to 2 ml of fluid being dispensed, however, other amounts are within the scope of the present disclosure. For example, the driver 66 can move the piston 56 to dispense between 0 and about 2 ml of fluid, although amounts greater than 2 ml are within the scope of the present disclosure. In one embodiment, the controller is configured to receive input from an operator indicative of the amount of fluid to be dispensed by the pumping system 10. The controller may also be configured to determine the distance needed to move the piston 46 to dispense the selected amount of fluid based on the input and the cross-sectional area of the discharge portion 44*a* and instruct (e.g., control) the driver 66 accordingly. As a result of the fluid being drawn into the discharge portion 44*a* of the chamber 44 under the force of the vacuum, no air is introduced into the fluid by the pumping system 10 (i.e. no air bubbles are trapped in the supply of fluid). This allows the pumping system 10 to deliver a continuous, uninterrupted and unbroken supply of fluid to the outlet 34 and any components connected thereto, such as the heated supply line 72. The pumping system 10 only delivers fluid when the piston 46 moves to the extended position. When the piston 46 moves to the retracted position, there is no delivery of fluid to the outlet 34.

Figure 10:
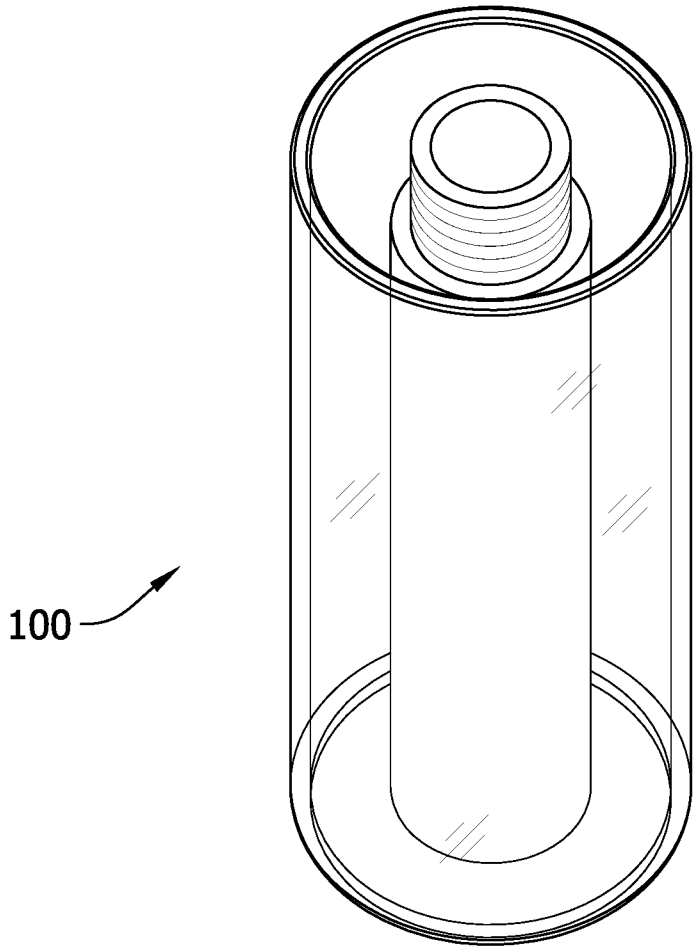
FIG. 10 is a perspective view of an empty electronic cigarette cartridge.

It is understood that the pumping system 10 can continue to move the fluid after the fluid has moved through the outlet 34. In one example, the heated supply line 72 is connected to the outlet 34 so that the pumping system 10 moves the fluid through the heated supply line 72 to the injection outlet 74. As described above, the heated supply line 72 is heated by the heating wrapper (not shown). The heating wrapper heats the heated supply line 72 and the fluid contained therein, to maintain the fluid in the flowable state. In this example, the injection outlet 74 can be moved between various locations by a dispensing device (not shown), such as a robotic arm, to dispense the fluid into various containers. For example, electronic cigarette cartridges 100 (FIG. 10) can be filled with distilled THC using the dispensing device to position the injection outlet 74 and the pumping system 10 to move the distilled THC. The dispensing device can also be the controller for the driver 66 and can direct the driver to move the piston 46 the precise amount to fill an individual cartridge 100. Previous methods for filling electronic cigarette cartridges 100 with distilled THC required heating the THC and using syringes to fill the cartridges by hand. The distilled THC would be heated to temperatures up to 100° C. (212° F.), to ensure the THC did not solidify in the syringe before being placed in the cartridge 100. Due to the high-viscosity of distilled THC and the inexact nature of filling electronic cigarette cartridges 100 by hand with syringes, air bubbles are often trapped in the THC contained within the cartridges. This can significantly reduce the amount of distilled THC contained within the electronic cigarette cartridge 100, as typical cartridges only hold between 0.5 and 1 ml (0.017-0.034 fl oz) of fluid. Filling electronic cigarette cartridges 100 using the pump system 10 provides an uninterrupted supply of distilled THC to the cartridges, reducing the likelihood of air bubbles being trapped in the THC held in the cartridge. Moreover, because the components coming into contact with the distilled THC are heated—the reservoir 12, the housing 36, and the heated supply line 72—the pump system 10 maintains the distilled THC in a flowable state, eliminating the need to overheat the THC to 100° C. (212° F.). Moreover, the driver 66 can operate the piston 46 to dispense the exact amount of distilled THC required to fill the cartridge 100.

Pumping system 10 offers several additional advantages over previous pumping systems. As a result of the close proximity of the reservoir 12 to the chamber 44, the chamber/piston configuration to move the fluid and the creation of a vacuum to draw fluid into the chamber, the pumping system 10 requires less fluid for priming (the amount of fluid the pump requires to operate), than other pumps. It is understood that the amount of fluid required to prime the pump corresponds to the amount of fluid that remains in the pump after the supply of fluid to the pump has run out. With fluids that are solid at room temperature, like distilled THC, the fluid remaining in the pump will solidify and can damage or destroy the pump. Accordingly, the pump is often cleaned after use with any fluid remaining in the pump being discarded. As a result of the pumping system 10 requiring less fluid for priming, there is less fluid to solidify and possibly damage the pumping system. Moreover, less fluid is discarded when the pumping system 10 is cleaned after use.

As a result of the various components of the pumping system 10 being removable secured or connected to one another (modular components), the pumping system can be easily broken down for cleaning. In one example, the reservoir 12, housing 36, piston 46 and shaft seal assembly 76 are separated from one another for individual cleaning of each component.

The abstract and summary are provided to help the reader quickly ascertain the nature of the technical disclosure. They are submitted with the understanding that they will not be used to interpret or limit the scope or meaning of the claims. The summary is provided to introduce a selection of concepts in simplified form that are further described in the Detailed Description. The summary is not intended to identify key features or essential features of the claimed subject matter, nor is it intended to be used as an aid in determining the claimed subject matter.

The order of execution or performance of the operations in embodiments of the aspects of the disclosure illustrated and described herein is not essential, unless otherwise specified. That is, the operations may be performed in any order, unless otherwise specified, and embodiments of the aspects of the disclosure may include additional or fewer operations than those disclosed herein. For example, it is contemplated that executing or performing a particular operation before, contemporaneously with, or after another operation is within the scope of aspects of the disclosure.

It is intended that all patentable subject matter disclosed herein be claimed and that no such patentable subject matter be dedicated to the public. Thus, it is intended that the claims be read broadly in light of that intent. In addition, unless it is otherwise clear to the contrary from the context, it is intended that all references to "a" and "an" and subsequent corresponding references to "the" referring back to the antecedent basis denoted by "a" or "an" are to be read broadly in the sense of "at least one." Similarly, unless it is otherwise clear to the contrary from the context, the word "or," when used with respect to alternative named elements is intended to be read broadly to mean, in the alternative, any one of the named elements, any subset of the named elements or all of the named elements.

In view of the above, it will be seen that several advantages of the aspects of the disclosure are achieved and other advantageous results may be attained.

Not all of the depicted components illustrated or described may be required. In addition, some implementations and embodiments may include additional components. Variations in the arrangement and type of the components may be made without departing from the spirit or scope of the claims as set forth herein. Additional, different or fewer components may be provided and components may be combined. Alternatively or in addition, a component may be implemented by several components.

The above description illustrates the aspects of the disclosure by way of example and not by way of limitation. This description enables one skilled in the art to make and use the aspects of the disclosure, and describes several embodiments, adaptations, variations, alternatives and uses of the aspects of the disclosure, including what is presently believed to be the best mode of carrying out the aspects of the disclosure. Additionally, it is to be understood that the aspects of the disclosure is not limited in its application to the details of construction and the arrangement of components set forth in the following description or illustrated in the drawings. The aspects of the disclosure are capable of other embodiments and of being practiced or carried out in various ways. Also, it will be understood that the phraseology and terminology used herein is for the purpose of description and should not be regarded as limiting.

Having described aspects of the disclosure in detail, it will be apparent that modifications and variations are possible without departing from the scope of the disclosure as defined in the appended claims. For example, where specific values (such as but not limited to dimensions) are given, it will be understood that they are exemplary only and other values are possible. It is contemplated that various changes could be made in the above constructions, products, and methods without departing from the scope of aspects of the disclosure. In the preceding specification, various preferred embodiments have been described with reference to the accompanying drawings. It will, however, be evident that various modifications and changes may be made thereto, and additional embodiments may be implemented, without departing from the broader scope of the disclosure as set forth in the claims that follow. The specification and drawings are accordingly to be regarded in an illustrative rather than restrictive sense.

What is claimed is:

1. A high-viscosity fluid pumping system comprising:

a reservoir defining an interior for holding a fluid;

a pump assembly having an inlet and an outlet, the pump assembly including:

a housing having an inner surface defining a chamber, the inlet providing fluid communication between the interior of the reservoir and the chamber, and the chamber being in fluid communication with the outlet, a check valve positioned between and fluidly connected to the outlet and the chamber, the check valve configured to permit the fluid to move from the chamber to the outlet, and a piston positioned in the chamber and configured to move from a retracted position, in which the chamber is in open, uninterrupted fluid communication with the reservoir via the inlet, to an extended position to move the fluid through the check valve toward the outlet; and a first heater coupled to the housing of the pump assembly and configured to heat the inner surface of the housing to heat the fluid contained in the chamber of the pump assembly;

wherein the inlet is an elongate slot defined by the housing, the elongate slot being elongate in an elongation direction that is generally parallel to movement of the piston within the chamber;

wherein the elongate slot includes a wide section and a narrow section, the wide section disposed at an end of the elongate slot closest to the check valve, the wide section having a wide section width that is larger than a narrow section width of the narrow section, the narrow section of the elongated slot having opposing first and second sides extending from the wide section in a same direction, said same direction being generally parallel to the movement of the piston within the chamber.

2. The high-viscosity fluid pumping system of claim 1, further comprising a second heater configured to heat the fluid in the reservoir.

3. The high-viscosity fluid pumping system of claim 1, wherein the check valve and piston are configured to form a vacuum in the chamber as the piston moves from the extended position to the retracted position.

4. The high-viscosity fluid pumping system of claim 1, wherein the check valve is in fluid communication with the inlet when the piston is in the retracted position.

5. The high-viscosity fluid pumping system of claim 1, wherein the reservoir is located above the housing, the reservoir having an open base fluidly connected to the elongate slot.

6. The high-viscosity fluid pumping system of claim 4, wherein the piston, the housing and the reservoir are modular components configured to be removably connected such that the piston, the housing and the reservoir can be separated from one another.

7. The high-viscosity fluid pumping system of claim 4, further comprising a seal located between the reservoir and the housing to provide a fluid tight fit between the reservoir and the housing.

8. The high-viscosity fluid pumping system of claim 1, wherein the check valve and piston are configured to form a vacuum in the chamber as the piston moves to the retracted position, and wherein the piston in the retracted position is configured to allow a chamber outlet of the chamber to be in open, uninterrupted fluid communication with the inlet whereby fluid is drawn into the chamber by the force of the vacuum in the chamber.

9. The high-viscosity fluid pumping system of claim 8, further comprising a pressure fitting in fluid communication with the interior of the reservoir, the pressure fitting configured to be connected to a pressure source to pressurize the fluid in the reservoir and wherein the fluid is driven into the chamber by the force of the pressurized fluid in the reservoir at the same time the fluid is drawn into the chamber by the force of the vacuum.

10. The high-viscosity fluid pumping system of claim 9, wherein the check valve has a cracking pressure of at least 0.5 psi and wherein the first heater maintains the fluid at temperature above 21° C. in order to decrease the viscosity of the fluid.

11. The high-viscosity fluid pumping system of claim 1, further comprising an injection outlet and a heated supply line, the heated supply line configured to connect to the outlet of the pump assembly and the injection outlet at opposite ends thereof to provide fluid communication between the injection outlet and the outlet of the pump assembly.

12. The high-viscosity fluid pumping system of claim 1, further comprising a driver operatively connected to the piston to move the piston between the retracted and extended positions.

13. The high-viscosity fluid pumping system of claim 12, further comprising a controller configured to operate the driver.

14. The high-viscosity fluid pumping system of claim 12, wherein the driver is configured to move the piston different distances from the retracted position toward the extended position to dispense different amounts of fluid through the outlet, the amount of fluid dispensed corresponding to the distance the piston is moved by the driver.

15. The high-viscosity fluid pumping system of claim 12, further comprising a transfer block slidably mounted on a rail, the transfer block connected to the piston and the driver to operatively connect the piston to the driver, the transfer block configured to slide along the rail as the driver moves the piston between the retracted and extended positions.

16. The high-viscosity fluid pumping system of claim 15, further comprising a limit switch configured to be engaged by the transfer block to stop the driver and/or calibrate the driver.

17. The high-viscosity fluid pumping system of claim 1, wherein the reservoir includes a removable lid, the reservoir including a seal configured to provide a fluid tight fit between the reservoir and the lid.

18. The high-viscosity fluid pumping system of claim 1, wherein the first heater underlies the chamber.

19. The high-viscosity fluid pumping system of claim 1, wherein a first conductive heat path extending from the first heater to the inner surface is shorter than a second conductive heat path extending from the first heater to the interior of the reservoir.

20. The high-viscosity fluid pumping system of claim 1, wherein the first and second sides of the narrow section of the elongate slot are parallel to one another.

* * * * *